US005396154A

United States Patent [19]

Shiy et al.

[11] Patent Number: 5,396,154

[45] Date of Patent: Mar. 7, 1995

[54] STABILIZER CIRCUIT HAVING MEANS FOR ADJUSTING THE LIGHT OF THE LAMPS

[76] Inventors: Liang F. Shiy, No.98, Kun Shui Road, Yen Chao, Hsiang, Kao Hsiung Hsien; Chen C. Wang, No.498, Sec.2, Ching Nien Road,, Feng Shan Shih, Kao Hsiung Hsien, both of

[21] Appl. No.: 143,201

[22] Filed: Oct. 26, 1993

[51] Int. Cl.[6] ..... H05B 37/00

[52] U.S. Cl. ..... 315/291; 315/307; 315/308; 315/209 R; 315/DIG. 4

[58] Field of Search ..... 315/291, 307, 308, 243, 315/209 R, 212, 283, DIG. 4

[56] References Cited

U.S. PATENT DOCUMENTS 4,327,309 4/1982 Wallot ..... 315/311

5,170,068 12/1992 Kwiatkowski et al. ..... 315/291

*Primary Examiner*—Benny Lee

*Assistant Examiner*—Reginald A. Ratliff

*Attorney, Agent, or Firm*—Pro-Techtor International

[57] ABSTRACT

A stabilizer circuit includes a double stabilization device having two active terminals exchangeable with each other when a power switch is turned off and turned on one time, a relay has a coil connected to one of the terminals of the double stabilization device, two capacitors or inductors are connected to the lamp and coupled to the coil of the relay, and have different capacitances or inductances, such that the output energy and the lightness of the lamp can be adjusted.

3 Claims, 3 Drawing Sheets

STABILIZER CIRCUIT HAVING MEANS FOR ADJUSTING THE LIGHT OF THE LAMPS

BACKGROUND OF THE INVENTION

1. Field of the Invention

The present invent ion relates to a stabilizer, and more particularly to a stabilizer circuit having means for adjusting the light of the lamps.

2. Description of the Prior Art

Two typical stabilizers 10 are shown in FIGS. 1 and 2 anti each should include a switch 11 coupled thereto for adjusting the light or lightness of the lamps 12.

The present invention has arisen to mitigate and/or obviate the afore-described disadvantages of the conventional stabilizers.

SUMMARY OF THE INVENTION

The primary objective of the present invention is to provide a stabilizer which includes means for adjusting the light of the lamps.

In accordance with one aspect of the invention, there is provided a stabilizer circuit comprising a power switch, a lamp, a double stabilization device including first active terminals and second active terminals, the first and second active terminals being consecutively activated when the power switch is turned on and off one time, a relay including a coil connected to one of the active terminals of the double stabilization device, and two connected to the lamp and coupled to the coil of the delay, the means including two different values for adjusting output values of the lamp so as to adjust the lightness of the lamp.

The two means may be two inductors coupled together in series and having different inductance and coupled to the coil of the relay, the relay includes a first terminal connected to a position between the inductors, and a second terminal connected to an end portion of the inductors.

The two means may be two capacitors coupled together in parallel with each other and having different capacitance, and the relay includes a terminal connected between the capacitors.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
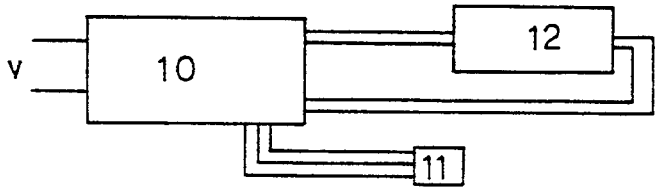
FIG 1. (PRIOR ART)
FIGS. 1 and 2 are schematic views illustrating two typical stabilizers.
Figure 2:
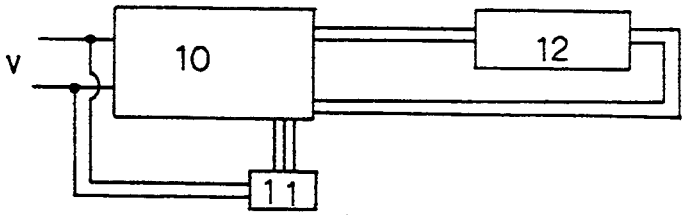
FIG2. (PRIOR ART)
Figure 3:
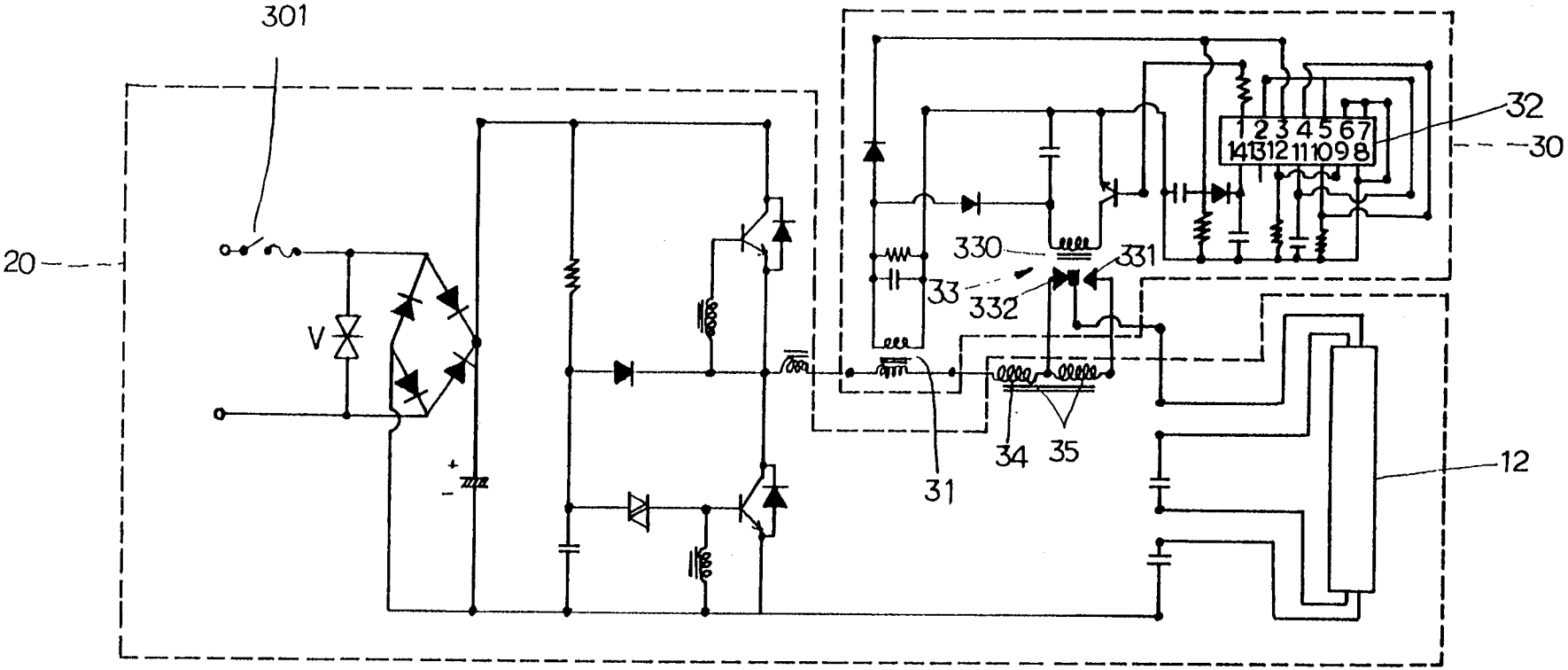
FIGS. 3 and 4 are schematic views illustrating two types of a stabilizer circuit in accordance with the present invention.

Referring to the drawings, and initially to FIG. 3, a stabilizer circuit in accordance with the present invention comprises a typical circuit 20 having a lamp 12 and a switch 301 provided therein, and the improvement comprises an adjusting circuit 30 which includes a transformer 31 for generating DC current and a pulse to a double stabilization device 32 which includes two active terminals, the active terminals will be alternated when the double stabilization device 32 receives the pulse from the transformer 31, a relay 33 includes a coil 330 connected to the double stabilization device 32 and includes two terminals 331, 332, the first active terminals of the double stabilization device 32 are connected to the coil 330 of the relay 33, two inductors 34, 35 in which the first inductor 34 has a greater inductance value than that of the second inductor 35, the first inductor 34 is connected to the second terminal 332 and the second inductor 35 is connected to the first terminal 331.

In operation, when the switch 301 is turned on, the transformer 31 generates and provides a DC current and a pulse to the double stabilization device 32 so as to actuate the first active terminals of the double stabilization device 32, at this moment, the coil 330 is connected to the double stabilization device 32 such that the second terminal 332 is turned off and the first terminal 331 is turned on, and such that the inductor 35 is actuated, because the inductor 35 has a greater inductance value, the frequency of the circuit will be decreased and the output will also be decreased, whereby, the light of the lamp is decreased.

When the switch 301 is turned off and turned on again, the other active terminals of the double stabilization device 32 are actuated or turned on such that the coil 330 is not energized and such that the second terminal 332 of the relay 33 is connected and the first terminal 331 is turned off, at this moment, the inductor 34 is actuated such that the frequency is increased and the light of the lamp is also increased.

Figure 4:
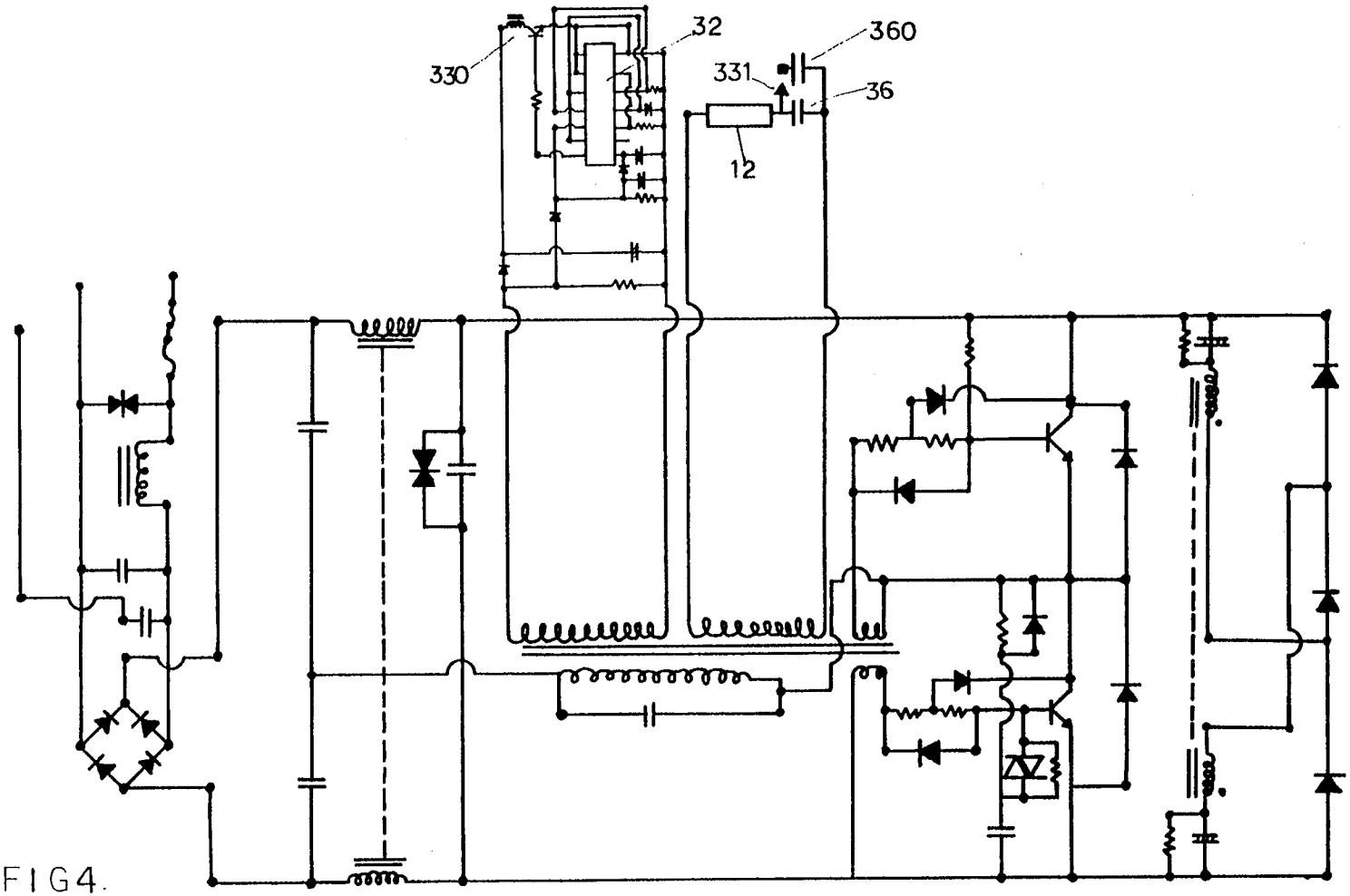

Referring next to FIG. 4, illustrated is another type of the stabilizer circuit, in which the coil 330 of the relay 33 is connected to one of the active terminals of the double stabilization device 32 similar to that shown in FIG. 3, the lamp 12 is connected to a capacitor 36, another capacitor 360 is disposed in parallel to the capacitor 36, and a switch 331 of a relay is connected between the capacitors 36, 360.

In operation, when the power switch is turned on and when the double stabilization device 32 is not connected to the active terminal of the coil 330 of the relay 33, only the capacitor 36 is actuated such that the capacitance of the circuit is low and the lamp 12 has lower lightness.

When the power switch is turned off and turned on again, the double stabilization device 32 is connected to the active terminal of the coil 330 of the relay 33 such that the coil 330 is energized, at this moment, both of the capacitors 36, 360 are coupled together and actuated such that the capacitance of the circuit is increased and the lamp 12 has an increased lightness.

Accordingly, the light or the lightness of the lamp can be easily changed by the stabilizer circuit in accordance with the present invention.

Although this invention has been described with a certain degree of particularity, it is to be understood that the present disclosure has been made by way of example only and that numerous changes the detailed construction and the combination and arrangement of parts may be resorted to without departing from the spirit and scope of the invention as hereinafter claimed.

I claim:

1. A stabilizer circuit comprising:

a power switch;

a lamp;

a double stabilization device;

a relay including a coil; and means to adjust the power output of the circuit; wherein said means to adjust the power output includes two adjusting elements, and said means is connected between said relay and said lamp;

said stabilization device includes at least two active terminals, a first active terminal which is activated when the power switch is turned on once, thereby activating a first terminal of said relay, said first terminal of said relay closing a circuit such that both adjusting elements are included in a power flow path, and a second active terminal which is activated when the power switch is turned off and on again, thereby activating a second terminal of said relay, said second terminal of said relay closing a circuit such that only one adjusting element is included in the power flow path.

2. The circuit of claim 1 wherein:

said adjusting elements of said means to adjust the power output are inductors wired in series, a first inductor having a different capacitance value from a second inductor.

3. The circuit of claim 1 wherein:

said adjusting elements of said means to adjust the power output are capacitors wired in parallel, a first capacitor having a different capacitance value from a second capacitor.

* * * * *